US006298612B1

(12) United States Patent
Adams

(10) Patent No.: US 6,298,612 B1
(45) **Date of Patent: *Oct. 9, 2001**

(54) WALL STRENGTHENING COMPONENT

(76) Inventor: James A. Adams, 2171 Halekoa St., Honolulu, HI (US) 96821

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/593,644

(22) Filed: Jan. 29, 1996

Related U.S. Application Data

(60) Provisional application No. 60/003,181, filed on Sep. 5, 1995.

(51) Int. Cl.[7] ..... E04B 2/70

(52) U.S. Cl. ..... 52/167.3; 52/236.3; 52/656.1; 52/693

(58) Field of Search ..... 52/167.3, 693, 52/656.1, 236.3, 236.6, 236.7, 236.9, 262, 264

(56) References Cited

U.S. PATENT DOCUMENTS

| | | | | |
|---|---|---|---|---|
| 1,353,998 | * | 9/1920 | Laughlin | 52/693 |
| 1,622,962 | * | 3/1927 | Michoo | 52/693 |
| 2,053,226 | | 9/1936 | Ruge . | |
| 2,076,728 | * | 4/1937 | Keller | 52/236.7 |
| 2,124,519 | * | 7/1938 | Piersen et al. | 52/656.1 |
| 2,497,887 | | 2/1950 | Hilpert . | |
| 3,010,547 | * | 11/1961 | Foster | 52/656.1 |
| 3,304,675 | * | 2/1967 | Graham-Wood et al. | 52/236.6 |
| 3,875,719 | | 4/1975 | Menge . | |
| 3,916,578 | | 11/1975 | Forootan et al. . | |
| 4,016,698 | | 4/1977 | Rogers . | |
| 4,040,232 | | 8/1977 | Snow et al. . | |
| 4,065,218 | | 12/1977 | Biggane . | |
| 4,069,635 | | 1/1978 | Gilb . | |
| 4,074,487 | * | 2/1978 | Daniels et al. | 52/236.3 |
| 4,078,352 | | 3/1978 | Knowles . | |
| 4,157,002 | | 6/1979 | Adolph . | |
| 4,250,671 | | 2/1981 | Hirsch et al. . | |
| 4,295,318 | | 10/1981 | Perlman . | |
| 4,370,843 | | 2/1983 | Menge . | |
| 4,441,286 | * | 4/1984 | Skvaril | 52/236.3 |
| 4,441,289 | | 4/1984 | Ikuo et al. . | |
| 4,522,000 | | 6/1985 | Barari . | |
| 4,559,748 | | 12/1985 | Ressel . | |
| 4,563,851 | | 1/1986 | Long . | |
| 4,637,195 | | 1/1987 | Davis . | |
| 4,799,339 | | 1/1989 | Kobori et al. . | |
| 4,910,929 | | 3/1990 | Scholl . | |
| 4,937,997 | | 7/1990 | Thomas, Jr. et al. . | |
| 5,072,570 | | 12/1991 | Johnson . | |
| 5,664,388 | | 9/1997 | Chapman et al. . | |

* cited by examiner

*Primary Examiner*—Michael Safavi
(74) *Attorney, Agent, or Firm*—Welsh & Katz, Ltd.

(57) ABSTRACT

A wall strengthening component for a building construction, the building construction having a plurality of spaced apart vertical studs within a frame of a building wall or the like, the wall strengthening component includes first and second vertical support members disposed in a spaced apart relationship and a plurality of reinforcing members disposed between the first and second vertical support members. The reinforcing members are configured to resist lateral stress directed against the vertical support members such that the position of the first vertical support member is maintained relative to the position of the second vertical support member. The reinforcing members are configured in a truss-like arrangement forming triangular shaped portions between the vertical support members. The wall strengthening components configured to be operatively placed between adjacent vertical studs within the frame of the building wall or the like and is fastened to the building or the frame of the building wall at opposite vertical ends of the first and second vertical support members. If fabricated from several parts, the parts may be joined together by welds, crimps, screws, rivets, press-fit, chemical adhesive, and the like. The wall strengthening component may also be formed by molding, casting, stamping, and extrusion processes or may be fabricated as a solid monolithic form or a solid monolithic form having a plurality of apertures disposed therein.

11 Claims, 8 Drawing Sheets

WALL STRENGTHENING COMPONENT

This application claims benefit of Provisional Apllication No. 60/003,181 filed on Sep. 5, 1995.

BACKGROUND OF THE INVENTION

The present invention relates generally to light frame building construction and more specifically to reinforcing components for walls or framed portions of a building.

In the construction of light frame buildings, such as houses and apartment units, wood and metal light frame construction is conventionally known. Walls are generally fabricated as constructed frames formed of upright studs which are generally parallel to each other and separated at predetermined spacing intervals. Such construction is commonly referred to as "stick-built" or "stick-frame" construction, and is typically based upon vertical members or studs spaced apart at twelve to twenty-four inch intervals.

Several methods for reinforcing stud walls are known and are described below. Reinforcing stud walls is extremely important in order to avoid damage and structural failure of the building. This is especially true in areas where buildings are subject to shear forces or lateral forces created by high winds and by ground movement created by earthquakes. In the past few years, testing as well as environmental natural disasters, such as hurricanes and earthquakes, have illustrated that current methods for reinforcing light frame buildings are inadequate or insufficient. As such, building codes have been modified or are in the process of being modified to require stronger and more effective reinforcing methods. Each of the below described methods have proved to be questionable in light of such recent testing and natural disasters.

Mortise wood braces, commonly referred to as "let-in", are widely used for bracing stud walls. A mortise wood brace is generally formed from a one inch by four inch wooden strip fitted into the upstanding studs and extending diagonally thereacross. Such a brace requires that rectangular grooves or slots be carefully cut in each stud so that the stud can accept the brace in a manner which maintains a flush outer surface. In this respect, a flush outer surface on the wall frame is important in that sheets of wallboard are normally secured or fixed to the stud wall frame prior to installing exterior siding. The mortise brace thus produces a wall frame having a flush outer surface on which sheathing can easily be secured. It will be appreciated however, that cutting diagonal slots or grooves is very time consuming and labor intensive, and therefore very expensive.

To further reinforce such stud walls against shear forces, some light frame constructions rely upon external sheathing, such as plywood or particle board (generally 4' by 8' sheets) nailed to the upright studs and top and bottom plates. Additional resistance to earthquakes is achieved by adding "hold-down" hardware at each end of the wall. Such sheathing becomes an integral part of the wall and forms the surface of the wall. The sheathing additionally provides a surface upon which to apply the finish, such as wood shingles, aluminum siding, wooden plank, gypsum board and the like.

However, use of such sheathing has proved ineffective in preventing deformation of the wall under relatively moderate lateral or shear forces. Under sufficient lateral shear force, the nails securing the sheathing to the studs are loosened or are ripped loose as the vertical studs deform from a right-angle orientation to a non-square orientation. Deformation of the wall can lead to collapse of the building structure. Recent cyclical tests conducted in California along with experience gained from the Northridge earthquake in California have demonstrated that sheathing and various "hold-down" fasteners do not perform satisfactorily.

Another method of wall bracing is disclosed in U.S. Pat. No. 4,016,698 issued to Rogers. This patent discloses a galvanized steel strap which is nailed diagonally to the studs of a wall frame with ends of the strap bent over and rigidly fastened to the upper and lower wall plates. Although the metal strap provides good tensile strength, it does not have comparable compressive strength. Likewise, the strap is not completely suitable where openings, such as window and doors exist. Also, such a method is extremely dependent upon properly securing the end of the strap. Again, this method is time consuming and labor intensive and is not suitable for application in existing structures.

A further method of wall bracing is disclosed in U.S. Pat. No. 2,497,887 issued to Hilbert. This patent discloses a paneled building construction utilizing prefabricated wall sections having reinforcing beams disposed in poured concrete. The panels are fastened together to form walls and may even include apertures for windows and doors. However, the panels form the actual wall and are not configured to be placed between existing studs in light frame construction. Such panels are suited for large high-rise structures constructed using steel "I" beams and reinforced concrete. Use of the panels is particularly directed to rapid assembly of the building since the wall sections are prefabricated and are bolted into place. However, use of such prefabricated steel and concrete wall panels is very expensive and not well-suited for use in light frame construction. Additionally, such panels, even if sized for light frame construction, cannot be retrofitted into existing structures.

Accordingly, it is an object of the present invention to substantially overcome the above-described problems.

It is another object of the present invention to provide a wall strengthening component that can be retrofitted into existing structures and can be placed between vertical studs.

It is a further object of the present invention to provide a wall strengthening component that reinforces a wall against shear forces directed thereagainst.

It is an object of the present invention to provide a wall strengthening component that is fabricated by stamping, welding, casting, roll forming, molding, or the like, parts to create the wall strengthening component.

It is yet another object of the present invention to provide a wall strengthening component having a plurality of reinforcing members between the edges providing structural resistance to shear forces.

It is yet a further object of the present invention to provide a wall strengthening component where the reinforcing members are formed from truss portions having either "Z-shaped, X-shaped, or K-shaped portions.

It is a further object of the present invention to provide a wall strengthening component in the form of a solid monolith having apertures disposed therein.

SUMMARY OF THE INVENTION

The disadvantages of present reinforcing methods are substantially overcome with the present invention by providing a novel wall strengthening component.

The present invention is extremely economical as a minimum of metal is used to fabricate the wall strengthening component. Additionally, the wall strengthening component is prefabricated and well-suited for mass production techniques, thereby minimizing labor and reducing construction costs.

The use of only a few wall strengthening components disposed in the building of a light frame construction will substantially increase the structure's capacity to withstand high levels of shear force. The increase in shear force resistance could result in such a structure surviving a hurricane or earthquake with little or no damage.

One significant advantage of using the wall strengthening component is that only a few components are needed. This is because the wall strengthening component has high resistance per foot characteristics with respect to shear forces applied thereto. If the structure is being initially constructed, the wall strengthening component is placed between existing adjacent vertical studs. A "hat-channel" may be added to the wall strengthening component to provide a surface to which to affix sheathing, such as gypsum board or wallboard. Such use in new construction is extremely economical since very little additionally labor is required to install the wall strengthening components.

If an existing structure is to be retrofitted, the existing sheathing is removed and the wall strengthening component is placed between two studs. Some studs may need to be removed, depending upon the width of the wall strengthening component inserted. The wall strengthening component is then secured at top and bottom to the floor and ceiling, respectively. The sheathing is then attached, or in new construction reattached to the existing studs and to the hat channel if necessary. Inclusion of a few wall strengthening components along a wall in a light frame construction permits the structure to withstand a large amount of shear force applied laterally to the structure. Such wall strengthening components offer an extremely high degree of protection against shear forces created by hurricanes and earthquakes at a cost substantially below the cost of other methods. The wall strengthening component is exceptionally strong and is significantly stronger than currently available conventional materials and methods for reinforcement. For example, sheathing such as plywood or gypsum wallboard degrades under cyclical lateral forces resulting in damage to light frame construction. During repeated or cyclical loading, the nails tend to loosen. Thus, conventional walls tend to fail after repeated application of identical forces until catastrophic failure results. However, the wall strengthening component described below has a high loading capacity per foot and displays no degradation under cyclic loading conditions up to its rated capacity.

Another significant feature of the wall strengthening component is that it may be used in a variety of aspect ratios. For example, the wall strengthening component may be constructed having an aspect ratio of eighteen inches by ninety-six inches and the loading capacity per linear foot of wall would be as described above. However, it is known that plywood or gypsum wallboard offers almost no structural value when cut in sections as narrow as eighteen inches by ninety-six inches. Thus, the wall strengthening component is also extremely versatile and can be used in situations where conventional plywood or gypsum sheathing is unsatisfactory.

More specifically, the wall strengthening component of the present invention is used in a building construction where the building construction has a plurality of spaced apart vertical studs within a frame of a building wall or the like. The wall strengthening component includes first and second vertical support members disposed in a spaced apart relationship and a plurality of reinforcing members disposed between the first and second vertical support members. The reinforcing members are configured to resist lateral stress directed against the vertical support members such that the position of the first vertical support member is maintained relative to the position of the second vertical support member.

The reinforcing members further include a plurality of spaced apart horizontal braces each transversely disposed between the first and second vertical support members and affixed thereto at a substantially right angle. One or more diagonal braces are disposed between the first and second vertical support members and are disposed between adjacent horizontal braces, where the diagonal braces are affixed proximal to an intersection of the horizontal brace and the vertical support member. Also included may be one vertical channel member disposed between the first and second vertical support members where the channel member has oppositely disposed linear flange portions and a raised linear channel portion disposed between the flange portions. The flange portions are configured to be fixedly attached to the reinforcing members and the linear channel portion provides a surface to which a planar siding or sheathing and the like are fastened. The wall strengthening component is configured to be operatively placed between adjacent vertical studs within the frame of the building wall where the wall strengthening component is fastened to the building or the frame of the building wall at the top and bottom portions thereof.

Alternately, the wall strengthening component includes a substantially solid monolithic block having top and bottom surfaces for fastening the block to the building construction. The monolithic block also has side surfaces generally perpendicular to the top and bottom surfaces. The monolithic block includes a plurality of apertures formed through a thickness of the block where the apertures are arranged in a pattern in the block such that a portion of the block disposed around the apertures forms a predetermined pattern, for example, a trusslike pattern.

The truss-like pattern has a generally triangular shape and is arranged to resist lateral stress directed against the building wall such that the position of each of the studs within the frame of the building wall is maintained relative to the position of adjacent studs upon application of lateral stress to the building wall.

According to another embodiment, the reinforcing means has a generally rectangular shape with top and bottom surfaces for fastening the reinforcing means to the building construction. The reinforcing means resists lateral stress directed against the building wall such that the position of each of the studs within the frame of the building wall is maintained relative to the position of adjacent studs upon application of lateral stress to the building wall. The generally rectangularly shaped reinforcing means is integrally formed from a single sheet of material where the sheet of material has a plurality of predetermined bends disposed vertically along opposite lateral sides forming first and second vertical support members. The reinforcing means also includes a predetermined number of deformations integrally formed in the sheet of material where the deformations are disposed between the vertical support members in predetermined pattern, for example, a truss-like pattern.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Figure 1:
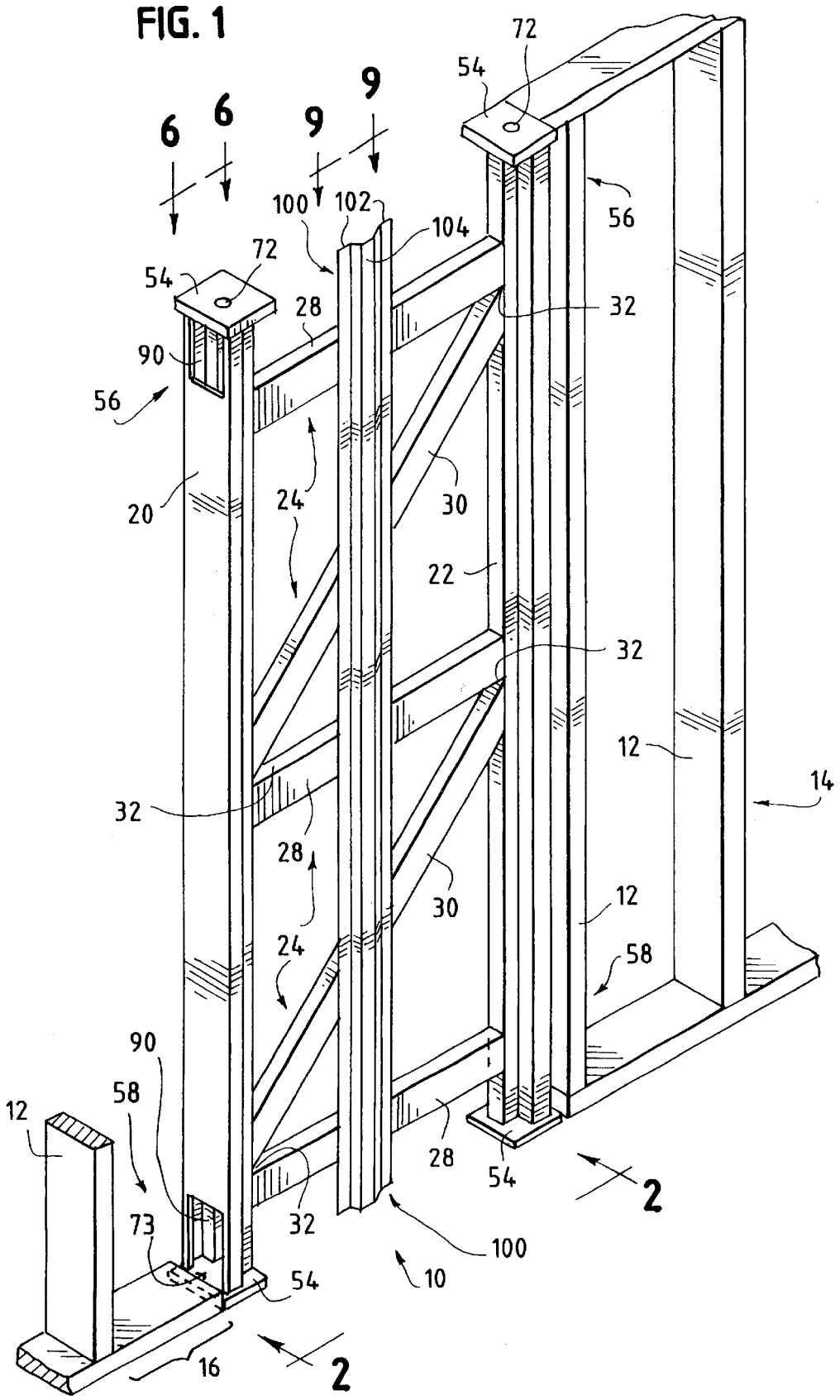
FIG. 1 is a perspective view of a specific embodiment of a wall strengthening component according to the present invention.
Figure 2:
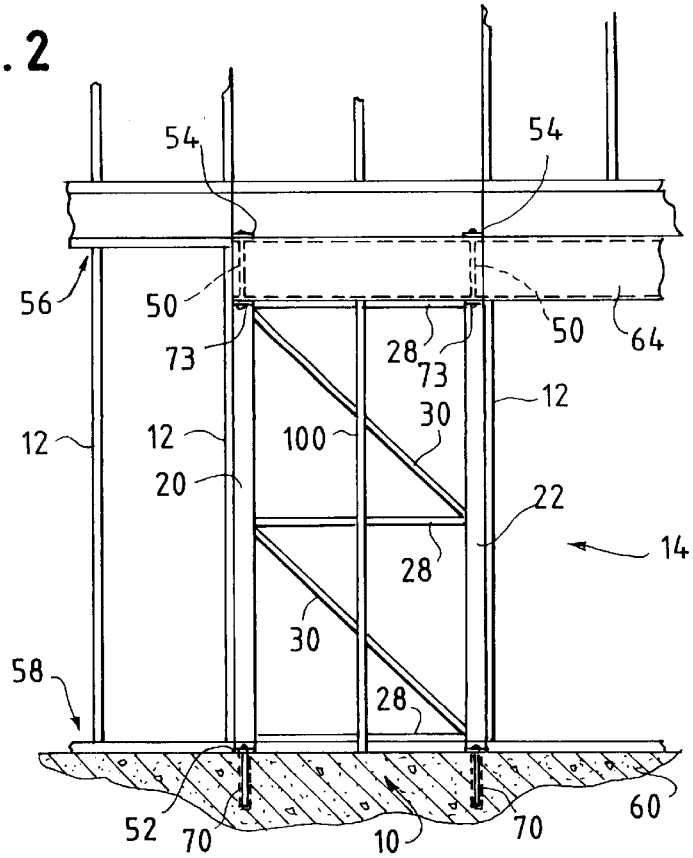
FIG. 2 is a front elevational view of the wall strengthening component of FIG. 1 shown installed in a building wall, taken along the line 2—2 of FIG. 1 in the direction generally indicated.
Figure 3:
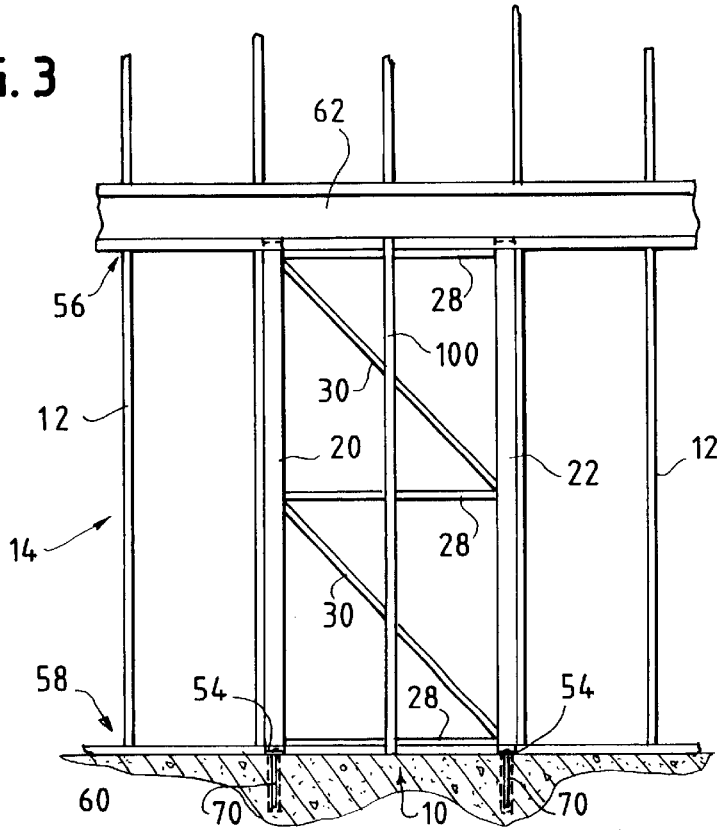
FIG. 3 is a front elevational view of the wall strengthening component of FIG. 1 shown installed in a building wall, taken along the line 2—2 of FIG. 1 in the direction generally indicated.

Referring now to FIGS. 1–3, a wall strengthening component 10 is shown generally disposed between spaced apart vertical studs 12 of a frame wall 14. As shown in the illustrated example, one of the existing studs 12 may be removed and the wall strengthening component 10 inserted and secured between the two remaining adjacent studs. Note that the wall strengthening component 10 need not be disposed directly against each stud 12 forming its border. A gap 16 may exist between the wall strengthening component 10 and the nearest stud 12 and such placement does not result is loss of structural integrity or strength. It is merely a choice of convenience and stud spacing whether to place the wall strengthening component 10 in an abutting orientation or in a spaced orientation relative to the existing vertical studs 12.

The wall strengthening component 10 includes first and second vertical support members 20 and 22 disposed in a spaced apart relationship. The first and second vertical support members 20 and 22 are identical to each other and are oppositely disposed. A plurality of reinforcing members 24 are disposed between the first and second vertical support members 20 and 22 and are configured to permit the vertical support members to resist lateral stress directed thereagainst such that the position of the first vertical support member is maintained relative to the position of the second vertical support member.

The reinforcing members 24 preferably include three spaced apart horizontal braces 28 that are transversely disposed between the first and second vertical support members 20 and 22 and are affixed thereto at a substantially right angle. The horizontal braces 28 are preferably equally spaced along the length of the vertical support members 20 and 22. A diagonal brace 30 is disposed between adjacent horizontal braces 28, thus two diagonal braces are required to provide diagonal support to three horizontal braces. The diagonal braces 30 are affixed proximal to an intersection 32 of the horizontal braces 28 and the vertical support members 20 and 22.

It will be appreciated that the reinforcing members 24 need not be constructed in exactly the configuration illustrated. The reinforcing members 24 are preferably formed in a predetermined pattern, for example, a truss-like arrangement. Preferably, a truss-like arrangement is any generally triangular shaped configuration, as is known in the construction industry. However, such a triangular shaped configuration need not be an exact triangle, but rather, may approximate a triangular shape. For example, a solid rectangular structure may have a progressive number of apertures placed therein. As the number of apertures increases, the remaining material begins to appear as a geometric pattern. When such apertures are placed in a predetermined pattern, such as in a generally triangular pattern, the truss-like pattern formed takes on the generally triangular shape. If only a few apertures are placed in the structure, the pattern formed by the material remaining may not appear to the human observer to have a definite pattern. However, such a pattern has structural significance where the material remaining in the structure provides structural support in specific directions relative to the structure. Alternately, the predetermined or truss-like pattern formed need not be triangular in appearance. Any suitable pattern capable of providing structural support in specific directions is an appropriate truss-like pattern. Any predetermined pattern that appears to provide ribs, linear portions or corrugations may provide a suitable pattern which significantly contributes to the structural integrity of the structure.

Figure 14A:
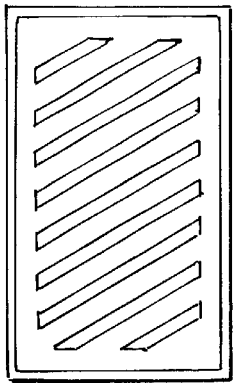
FIGS. 14A—14I illustrate predetermined structural patterns.
Figure 14B:
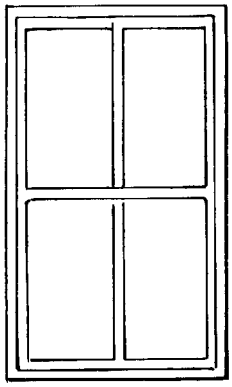
Figure 14C:
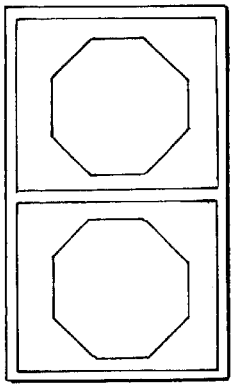
Figure 14D:
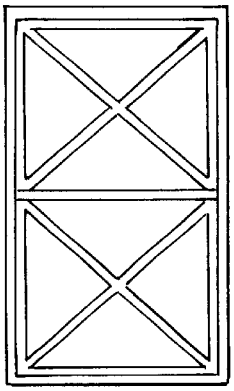
Figure 14E:
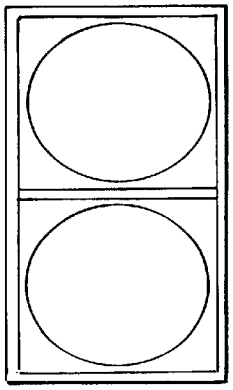
Figure 14F:
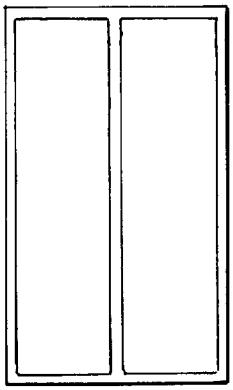
Figure 14G:
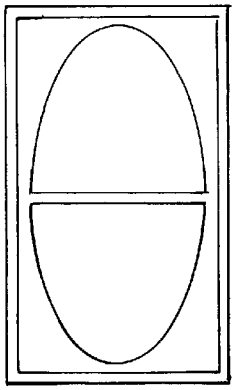
Figure 14H:
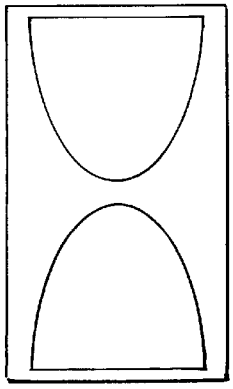
Figure 14I:
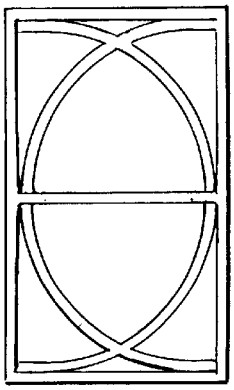

Referring now to FIGS. 14A–14I, various predetermined structural patterns are shown which provide significant structural strength to the wall strengthening component 10. In particular, FIGS. 14D and 14I are truss-like patterns while the remaining patterns illustrate various shaped apertures well-suited for providing the wall strengthening component 10 with the required structural integrity to withstand lateral force or shear force directed against the building construction.

In the illustrated embodiment of FIG. 1, the three spaced apart horizontal braces 28 are disposed between the first and second vertical support members 20 and 22 and one diagonal brace 30 is disposed between adjacent horizontal braces. The diagonal braces 30 are affixed proximal to the intersection 32 of the horizontal brace 28 and the vertical support members 20 and 22 such that two of the horizontal braces and one of the diagonal braces form a Z-shaped structure.

Figure 4A:
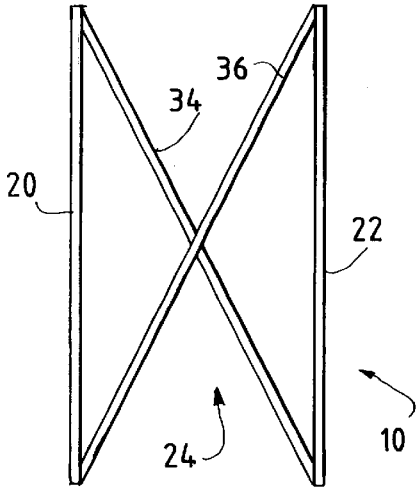
FIGS. 4A and 4B are front elevational views of an alternate embodiment of the wall strengthening component.

Referring now to FIG. 4A, an alternate embodiment of the wall strengthening component 10 is shown where like reference numerals refer to like structures. In this illustrated embodiment, the reinforcing members 24 include a first and a second diagonal brace 34 and 36 disposed between the first and second vertical support members 20 and 22 and affixed thereto. The first diagonal brace 34 intersects the second diagonal brace 36 to form an X-shaped structure. Again, the diagonal braces 34 and 36 form triangular shaped truss structures disposed between the vertical support members 20 and 22 and permit the vertical support members to resist lateral stress directed thereagainst such that the position of the first vertical support member is maintained relative to the position of the second vertical support member. Note that the diagonal braces 34 and 36 may be formed in several ways. The first diagonal braces 34 may be a single segment while the second diagonal brace 36 may be constructed from two individual segments. Alternately, each diagonal brace 34 and 36 may be constructed from two individual members fastened at the intersection thereof.

Figure 4B:
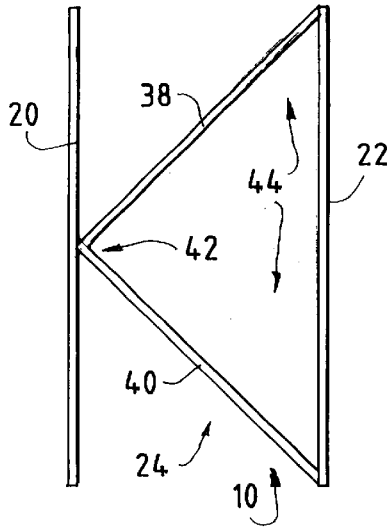

Referring now to FIG. 4B, an alternate embodiment of the wall strengthening component 10 is shown where like reference numerals refer to like structures. In this illustrated embodiment, the reinforcing members 24 include two diagonal braces 38 and 40 which meet at a common vertex 42 and have opposite ends 44 diverging away from the common vertex. The diagonal braces 38 and 40 and the first vertical support member 20 form a K-shaped structure such that the common vertex 42 is affixed to the first vertical support member 20 at a point about mid-way along the length of the vertical support member. The diverging ends 44 of the diagonal braces 38 and 40 are affixed to the second vertical support member 22. Again, the diagonal braces 38 and 40 form triangular shaped truss structures disposed between the vertical support members 20 and 22 and permit the vertical support members to resist lateral stress directed thereagainst such that the position of the first vertical support member is maintained relative to the position of the second vertical support member.

Referring back to FIGS. 1–3, each vertical support member 20 and 22 includes a footer plate 54 at upper 56 and lower ends 58. Each footer plate 54 provides an attachment point so that the wall strengthening component 10 can be affixed to the lower floor joists or foundation 60 (FIGS. 2–3) at its lower end 58 and to the upper floor joists 62 (FIG. 3) or header 64 (FIG. 2) at its upper end 56, as is shown in greater detail in FIGS. 2–3.

The wall strengthening component 10 is configured to be operatively placed between adjacent studs 12 within the frame of the building wall 14 or the like. Although not illustrated, the wall strengthening component 10 is also used in walls above the first floor. Thus, the wall strengthening component 10 may be disposed between lower floor joists on the bottom and upper floor joists or roof joists on the top.

A bolt 70 or other suitable fastener is received through an aperture 72 (FIG. 1) in each footer plate 54 to secure the wall strengthening component 10, as is known in the art. For example, the bolt 70 may be set into the concrete foundation when poured or may be drilled into the concrete foundation after formation and secured therein via cement or epoxy. The bolt 70 extends through the aperture 72 in the footer plates 54 and is secured with a nut 73 or other suitable fastener. The bolt 70 is also received through the aperture 72 of the footer plates 54 disposed toward the upper end 56 of the wall strengthening component 10 and the nut 73 or other fastener secures the bolt to the footer plates. Note that the wall strengthening component 10 need not be affixed to adjacent studs and attachment at upper and lower ends 56 and 58 to the wall frame 14 provides required structural integrity. Elimination of attachments along the vertical support members 20 and 22 saves construction costs and labor.

The wall strengthening component 10 is preferably constructed from light gauge sheet metal, preferably of twelve or fourteen gauge sheet metal. However, any suitable gauge metal may be used depending upon the size of the wall strengthening component 10 fabricated and the shear force and load bearing requirements of the wall strengthening component. The wall strengthening component 10 is formed from a metal form rolling process or from a metal stamping process, as is known in the art. As shown in FIGS. 1–3, the individual components of the wall strengthening component 10, such as the vertical support members 20 and 22, the horizontal braces 28, and the diagonal braces 30 are formed from individual form rolled metal components. The horizontal braces 28 and the diagonal braces 30 are affixed to the vertical support members 20 and 22 by a welded bead or by spot welds. The footer plates 54 are attached to the vertical support members 20 and 22 in a similar manner and may include additional reinforcement, as will be described in greater detail hereinafter. However, the horizontal braces 28 and the diagonal braces 30 may be affixed to the vertical support members 20 and 22 by welds, rivets, nut and bolt fasteners, crimps, screws, chemical adhesive, brackets and the like or any other suitable fastening method.

Figure 5:
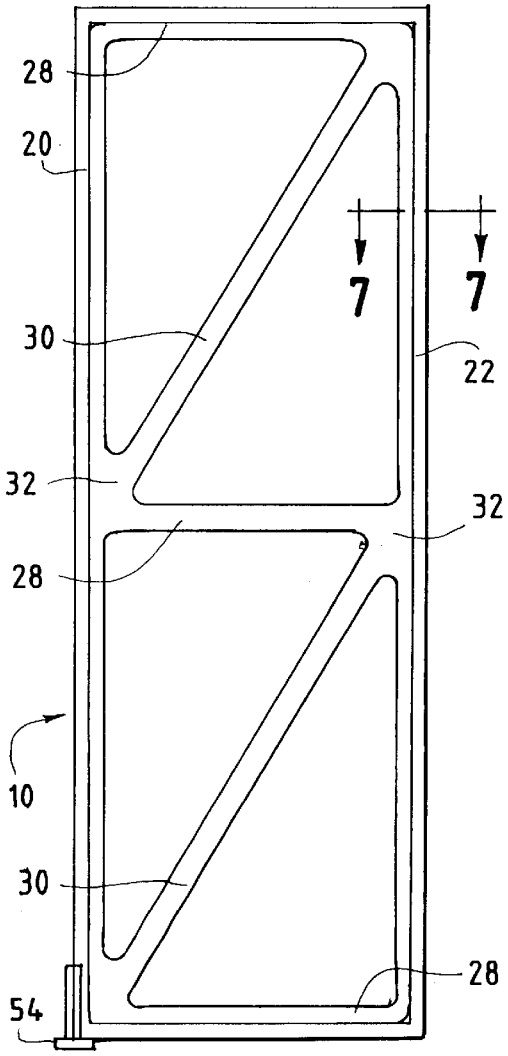
FIG. 5 is a front elevational view of a specific embodiment of a wall strengthening component according to the present invention, shown fabricated using a stamping process.

Referring now to FIG. 5, FIG. 5 illustrates the wall strengthening component 10 shown in FIG. 1 except that in this specific embodiment it is fabricated using a metal stamping process where each planar half of the wall strengthening component is produced as a single unitary section. Two half sections are then welded together along their common border by a bead weld or a spot weld. Thus, the vertical support members 20 and 22, the horizontal braces 28, and the diagonal braces 30 are all integrally formed with each other. Accordingly, no specific fastener is used to attach the horizontal braces 28 and the diagonal braces 30 to the vertical support members 20 and 22 since all members are integrally formed with each other. The footer plates 54 may also be integrally formed with the vertical support members 20 and 22 or may be separately attached by welds and the like. Note that the wall strengthening component 10 may also be fabricated from high strength plastic, carbon composite materials or any other suitable material. The wall strengthening component 10 may be stamped or may be formed using injection molding, casting, or extrusion processes, as is known in the art. Alternately, the wall strengthening component 10 may be stamped from a single unitary form in a corrugated manner such that no welds are required, as will be described in greater detail with respect to FIGS. 12 and 13 hereinafter.

Figure 6A:
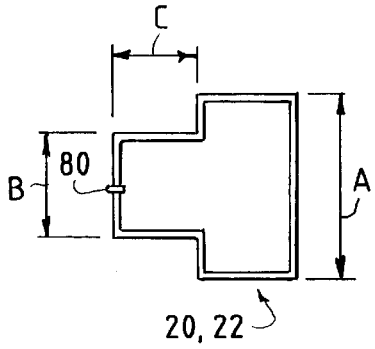
FIG. 6A is a head-on cross-sectional view of a vertical support member of FIG. 1, taken along the line 6—6 of FIG. 1 in the direction generally indicated.
Figure 6B:
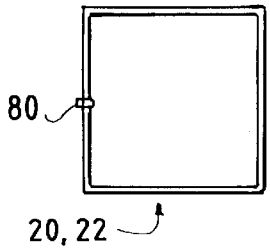
FIG. 6B is a head-on cross-sectional view of an alternate embodiment of a vertical support member of FIG. 1, taken along the line 6—6 of FIG. 1 in the direction generally indicated.

Referring now to FIGS. 6A and 6B, cross-sectional views of the vertical support members 20 and 22 are shown. Preferably, each vertical support member 20 and 22 has a T-shaped cross-sectional shape, as illustrated in FIG. 6A. Such a shape is inherently strong and offers great resistance to lateral forces. Alternately, each vertical support member 20 and 22 may have a generally rectangular cross-sectional shape, as shown in FIG. 6B, as such shapes are easy and economical to fabricate.

When fabricating the wall strengthening component 10 using the form rolled metal process, as illustrated in FIGS. 1–3, at least one welded seam 80 (FIGS. 6A–6B) is required to form a closed structure. The seam 80 may be secured using a welded bead, a spot weld, or a crimp or any other suitable method, as is known in the art. Note, although the vertical support members 20 and 22 are preferably T-shaped, for ease in attachment, the horizontal braces 28 and diagonal braces 30 preferably have a generally rectangular cross-sectional shape, similar to the rectangular cross-sectional shape of the vertical support members 20 and 22 illustrated in FIG. 6B. Note, however, that for the above-described embodiments, the vertical support members 20 and 22, the horizontal braces 28, and the diagonal braces 30 may have any suitable cross-sectional shape, such as circular, oblong, triangular or polygonal. For a typically dimensioned wall strengthening component 10, the outside dimensions of each vertical support member 20 and 22 is approximately three inches by three inches for the rectangular shaped vertical support member illustrated in FIG. 6B. For the T-shaped vertical support member shown in FIG. 6A, the bar portion of the "T" is about three inches wide, as illustrated by reference letter "A", the stem portion of the "T" is about one and one-half inches wide, as illustrated by reference letter "B", and the stem portion of the "T" is about one and one-half inches deep, as illustrated by reference letter "C".

Figure 7A:
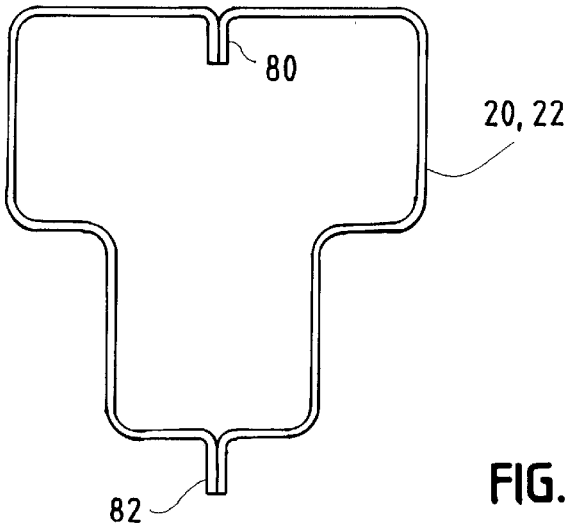
FIG. 7A is a head-on cross-sectional view of a vertical support member of FIG. 5, taken along the line 7—7 of FIG. 5 in the direction generally indicated.
Figure 7B:
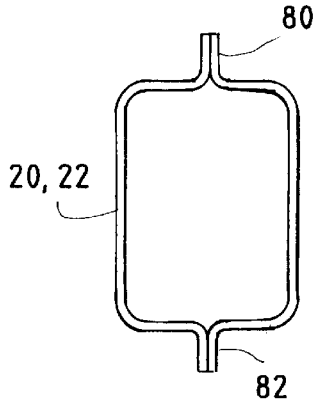
FIG. 7B is a head-on cross-sectional view of an alternate embodiment of a vertical support member of FIG. 5, taken along the line 7—7 of FIG. 5 in the direction generally indicated.

Referring now to FIGS. 5 and 7A–7B, FIGS. 7A–7B particularly show the wall strengthening component 10 of FIG. 5 where the two half sections are welded together along two seams 80 and 82. FIG. 7A illustrates the vertical support member 20 or 22 having a T-shaped configuration welded along two sides. Since each vertical support member 20 or 22 is integrally formed with the horizontal 28 and diagonal braces 30 of each half section, the braces (not shown in FIGS. 7A–7B) extend from the inside or second seam 82 of each vertical support member. FIG. 7B similarly illustrates that two welds 80 and 82 are required to form a closed structure for the rectangularly-shaped vertical support members 20 and 22.

Referring back to FIGS. 1–3, each vertical support member 20 and 22 may include an access aperture 90 disposed toward the footer plates 54. The access aperture 90 allows the nut 73 (FIG. 1) or other fastener to be tightened so that the footer plates 54 are securely affixed to the building foundation 60 and floor joists 62 or headers 64, thus fixedly securing the wall strengthening component 10 in place.

Figure 8:
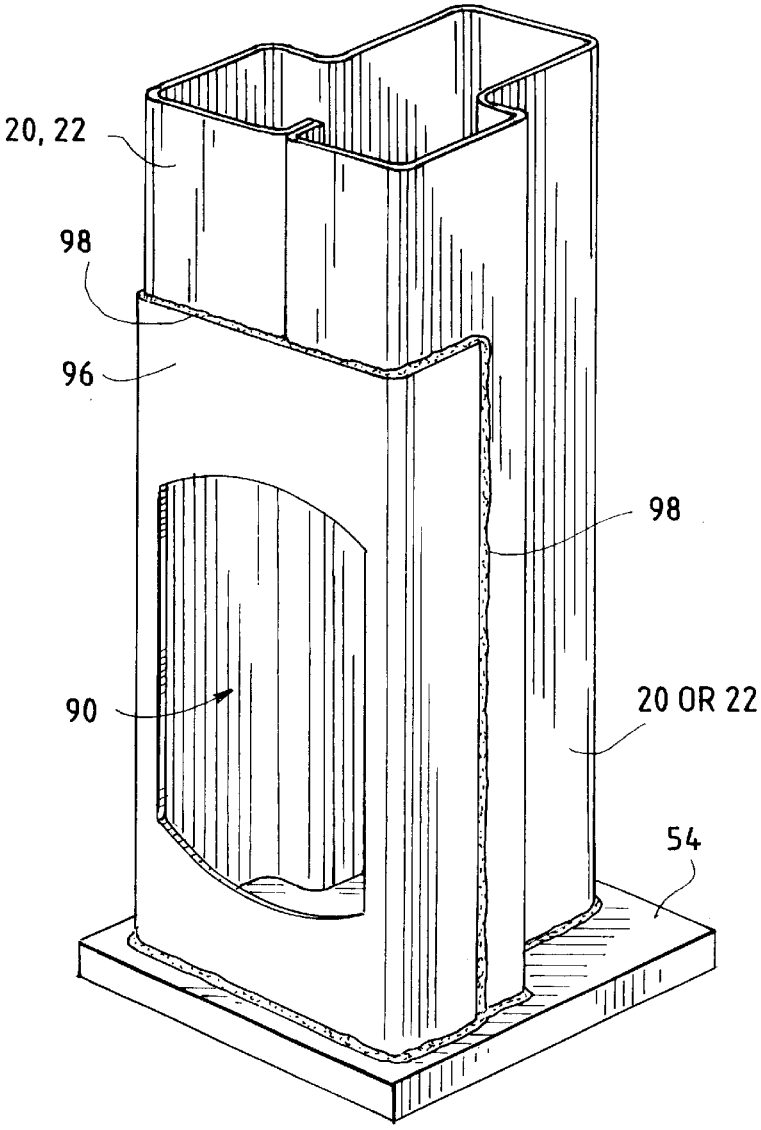
FIG. 8 is an enlarged perspective view of a footer plate and a vertical support member according to the present invention.

Referring now to FIG. 8, a reinforcing plate 96 may be welded to the footer plate 54 and to the vertical support members 20 and 22. The reinforcing plate 96 includes the access aperture 90 so that the hardware, such as the nut 73 (FIG. 1) may be tightened. A linear welded bead 98 disposed along the entire peripheral edge of the reinforcing plate 96 further secures the vertical support member 20 and 22 to the footer plate 54. The reinforcing plate 96, for example, may be constructed from ⅛ inch to 3⁄16 inch thick steel plate. However, any suitable thickness of steel plate may be used. Additionally, the reinforcing plate 96 increase the vertical load capacity of each vertical support member 20 and 22, thus increasing the load bearing capacity of the wall strengthening component.

Figure 9:
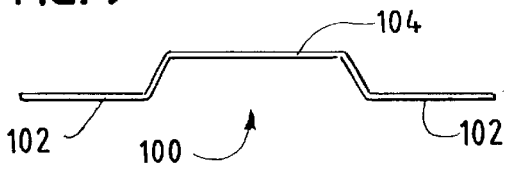
FIG. 9 is a head-on cross-sectional view of a hat-channel of FIG. 1, taken along the line 9—9 of FIG. 1 in the direction generally indicated.

Referring now to FIGS. 1 and 9, a "hat-channel" 100 is shown. In FIG. 1, the hat channel 100 is shown affixed to each horizontal brace 28 and may be affixed thereto by known means, such as rivets, bolts, welds, screws, crimps, brackets, chemical adhesive and the like. The hat channel 100 may be selectively positioned horizontally anywhere between the first and second vertical support members 20 and 22 and provides a surface to which a planar siding or sheathing and the like are fastened. The hat channel 100 is disposed between the first and second vertical members 20 and 22 and includes oppositely disposed linear flange portions 102 and a raised linear channel portion 104 disposed between the flange portions. The flange portions 102 are configured to be fixedly attached to the horizontal braces 28 and the sheathing or gypsum board is fastened to the linear channel portion 104 in the same manner that the sheathing would be attached to an existing vertical stud 12. Since the hat channels 100 are horizontally displacable, the sheathing may be affixed to vertical supports at standard intervals, such as sixteen or twenty-four inches, permitting the wall strengthening component 10 to be placed in the wall frame 14 without regard to placement at a specific location.

For example, in a typical light frame construction, each wall strengthening component 10 may be thirty-two inches wide by ninety-inches long. When such a wall strengthening component 10 is placed in a wall frame having a stud spacing of twenty-four inches, one stud is removed leaving a space of forty-eight inches between two adjacent studs. The wall strengthening component 10 is secured in place, and a total gap of sixteen inches remains. This means that the wall strengthening component 10 may be placed between the two adjacent studs 12 with a gap of eight inches on either side, or may be placed against one of the studs with a gap of sixteen inches on the other side. Of course, any variation in such placement is also possible and the wall strengthening component 10 may be constructed in any suitable size.

Another significant advantage of using the wall strengthening component 10 in construction is that the hat channels 100 may be placed on both inside and outside planar surfaces so that the channels face inward toward the interior of the structure and outward toward the exterior of the structure. If an external wall is constructed of multiple wall strengthening components 10, no exterior sheathing or gypsum board need be used. The wall strengthening components 10 alone offer sufficient structural strength so that outside sheathing or plywood sections need not be secured thereto. This saves considerable time and money. Once the wall strengthening components 10 are in place, suitable insulation is added, if needed, and the exterior protective or decorative material, such as wood shingles, aluminum siding, wooden plank and the like, is affixed directly to the outwardly facing hat channel 100 of each wall strengthening component 10. The cost of additional wall strengthening components 10 is offset by the elimination of the external sheathing.

Figure 10:
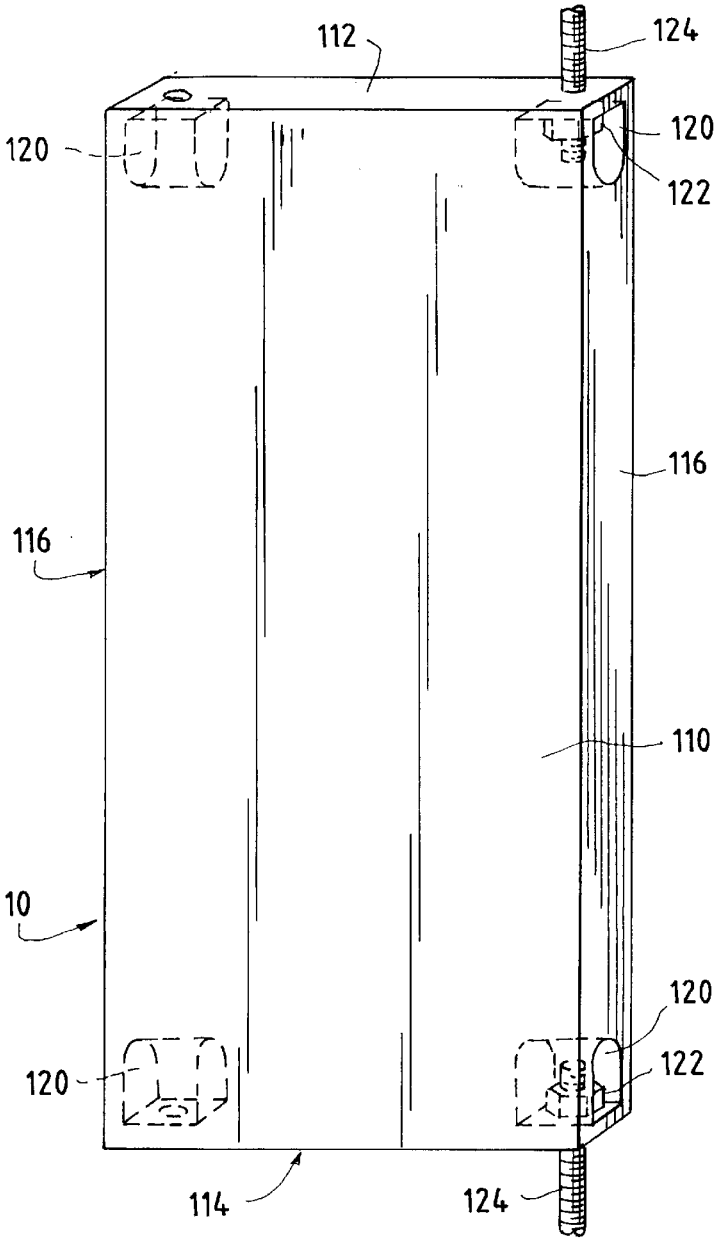
FIGS. 10 and 11 alternate embodiments of a wall strengthening component according to the present invention, shown in monolithic form.
Figure 11:
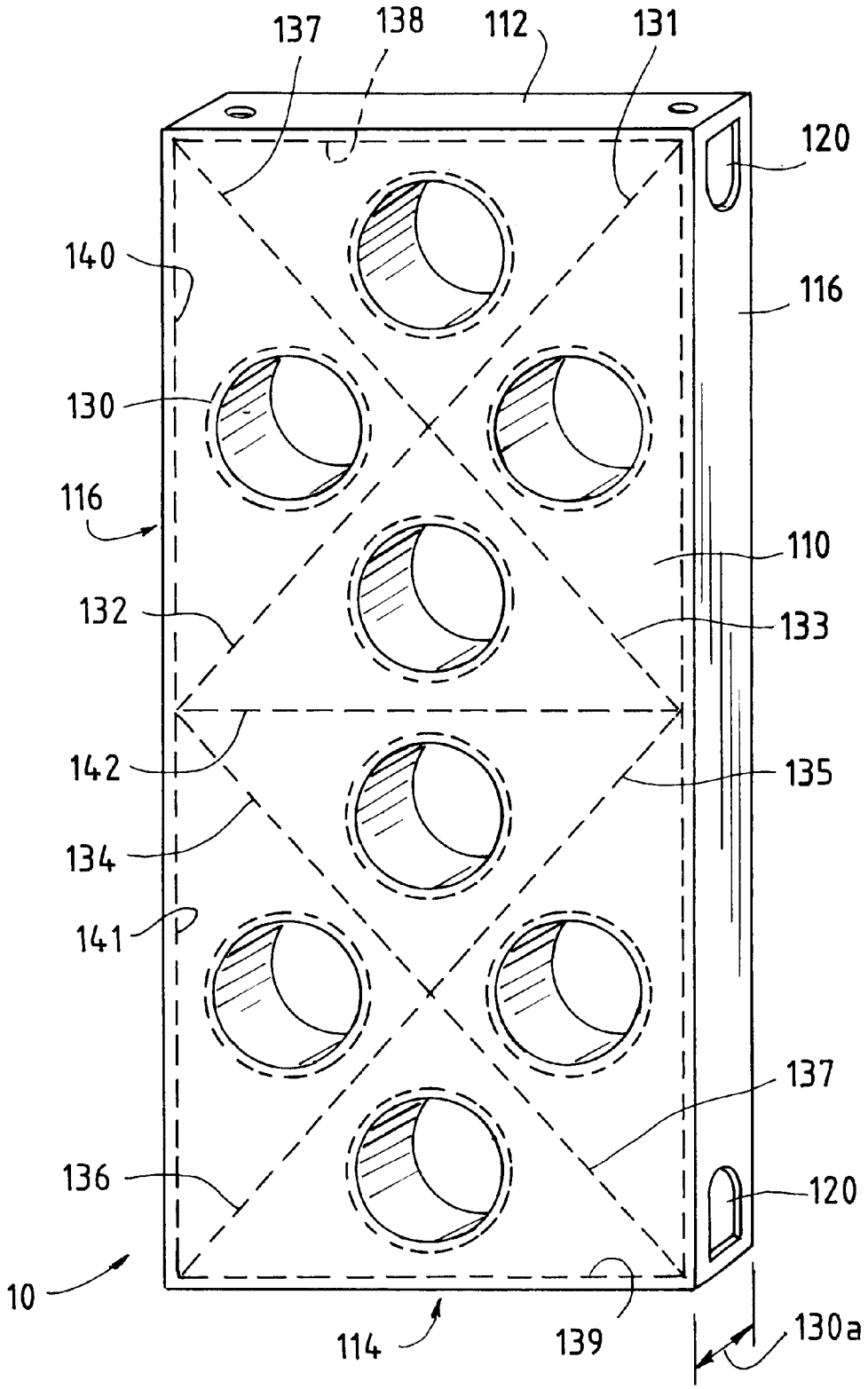

Referring now to FIGS. 10 and 11, alternate embodiments of the wall strengthening component 10 are shown. The wall strengthening component 10 need not be fabricated as separate sections fastened together, as illustrated in FIGS. 1–4, and further, need not be fabricated as segments integrally formed with other segments, as illustrated in FIG. 5.

The wall strengthening component 10 may be in the form of a substantially solid monolithic block 110, as shown in FIG. 10. The block 110 is generally rectangular in shape and has top 112 and bottom 114 surfaces for fastening the block to the building construction or frame wall 14 (FIG. 1). The block 110 also includes opposite side surfaces 116 generally perpendicular to the top and bottom surfaces 112 and 114.

The monolithic block 110 may be fabricated in a variety of processes, such as in a molding process, an injection molding process, a casting process, an extrusion processes, and the like. However, any suitable fabrication process may be used. The block 110 may also be fabricated from any material having suitable strength characteristics. Such materials include, but are not limited to concrete and cement, carbon composite materials, plastic, wood/wood by-products and epoxy combinations, metal, and the like.

The monolithic block 110 includes four access pockets or access apertures 120, each disposed toward a corner of the block. The access apertures 120 are similar to the access apertures 90 illustrated in FIGS. 1 and 8 and serve the same function. The access apertures 120 may be integrally formed in the block 110 when the block is initially formed, or may be formed by drilling, chiseling, or other known excavation means after the block has been fabricated. The access apertures 120, for example, permit placement of and access to a nut 122 and a bolt 124 which fasten the block 110 to the frame wall 14 (FIG. 1). In this way, the block 110 can be operatively placed between adjacent vertical studs 12 (FIG. 1) within the frame wall 14 (FIG. 1) of the building wall and fastened at top and bottom surfaces 112 and 114 thereof. Again, note that the block 110 is not fastened to the frame wall 14 along the side surfaces 116 and only requires fastening along the top and bottom surfaces 112 and 114. Such an arrangement permits quick and cost-effective installation of the wall strengthening component 10 in new construction and in existing construction.

Referring now to FIG. 11, the monolithic block 110 may include a plurality of apertures 130 formed through a thickness 130*a* of the block. Preferably, the apertures 130 are round but may be of any suitable shape, such as triangular, square, rectangular, oblong, or any other polygonal shape. The apertures 130 are arranged in a pattern in the block 110 such that a portion of the block disposed around the apertures, or the material remaining, forms a truss-like pattern. The truss-like pattern formed from the remaining material of the block 110 is illustrated in FIG. 11 by imaginary lines 131–141.

Various truss-like patterns may be formed within the material of the block 110 having a generally triangular shape. For example, a generally Z-shaped truss pattern is formed, as shown with lines 138, 131, 132, and 142 and is also shown with lines 142, 135, 136, and 139. Similarly, an X-shaped truss pattern is formed, as shown with lines 137, 133, 131, and 132 and is also shown with lines 134, 137, 135, and 136. Also formed is a K-shaped truss pattern, as shown with lines 140, 141, 131, 132, 134, and 137. The truss-like pattern in the monolithic block is arranged to resist lateral stress, such as shear forces, directed against the building wall 14 (FIG. 1) such that the position of each of the studs 12 (FIG. 1) within the frame of the building wall is maintained relative to the position of adjacent studs upon application of lateral stress to the building wall.

Note, that if only a few apertures 130 are disposed in the block 110, a truss-like pattern is not formed and the block structurally resembles the solid block shown in FIG. 10. As more apertures 130 are included, a greater portion of the material comprising the block is eliminated. An optimal number of apertures 130 exists when the remaining material resembles the truss-like pattern illustrated in FIG. 11. Eight apertures are shown in FIG. 11 for purposes of illustration only and a different number of apertures may be used. As discussed above, the predetermined pattern or truss-like pattern formed need not resemble a triangle and while such a resemblance is preferable, such a pattern may approach the shape of a triangle, but a human observer may not view the pattern as triangular in shape.

Figure 12:
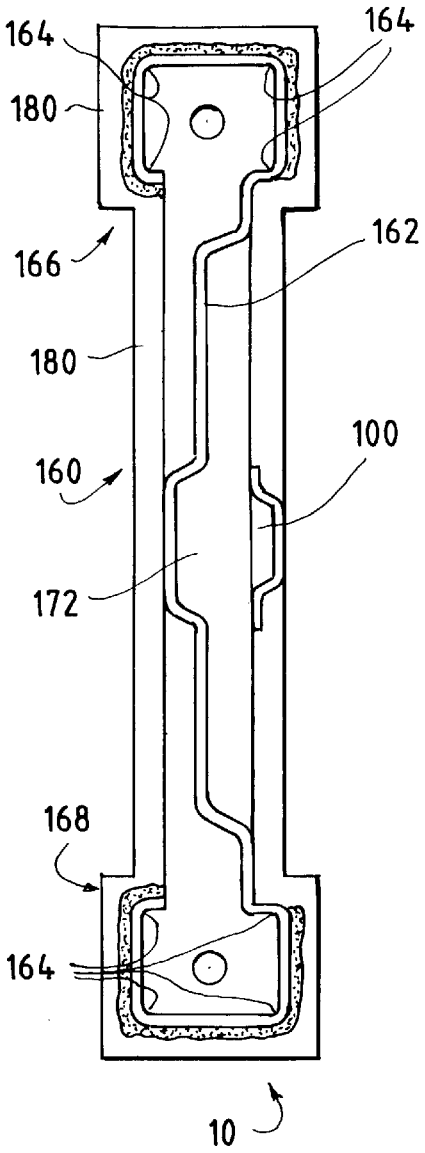
FIG. 12 is a head-on cross-sectional view of an alternate embodiment of a wall strengthening component according to the present invention, shown as a membrane-type component.
Figure 13:
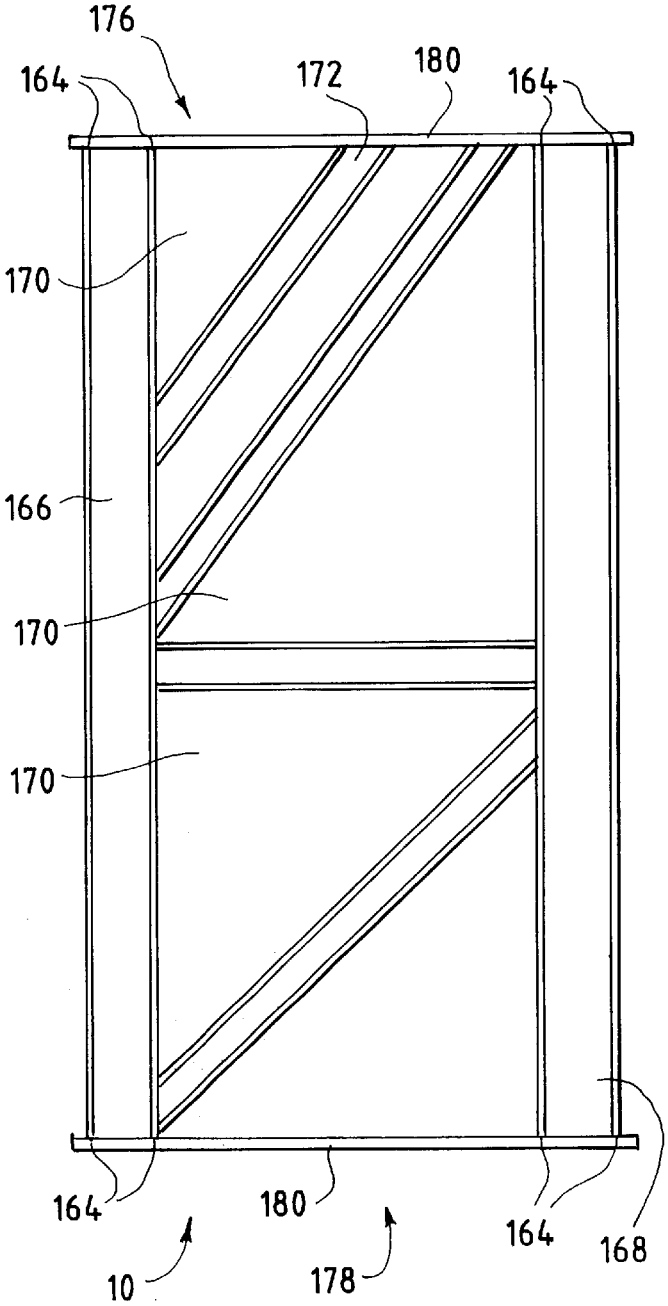
FIG. 13 is a, side view of the wall strengthening component shown in FIG. 12.

Referring now to FIGS. 12–13, an alternate embodiment of the wall strengthening component 10 is shown. The wall strengthening component 10 includes a generally rectangularly shaped reinforcing means 160 which is preferably integrally formed from a single sheet of material 162, such as from sheet metal. The metal may stamped or pressed from a single sheet, as is known in the art. However, suitable plastic material may be used to form the wall strengthening component 10.

The sheet of material 162 includes a plurality of predetermined bends 164 disposed vertically along opposite lateral sides. Such bends form first 166 and second 168 vertical support members. The material between the vertical support members 166 and 168 is essentially a "skin" or "diaphragm-type membrane" 170 integrally formed with the vertical support members. Such a single sheet of material 170, without the above-described bends 164, would provide little support. However, such bends 164 disposed vertically form rigid structural members, comparable in strength to solid, bulkier structures.

A predetermined number of deformations 172 are integrally formed in the sheet of material 170 and are disposed between the vertical support members 166 and 168 in a predetermined pattern. For example, a truss-like pattern may be used. At least one deformation is needed. The pattern of the deformations may be according to any of the above-described patterns illustrated with respect to other embodiments, such as a Z-shaped, X-shaped, or K-shaped arrangement. The deformations 172 may also be formed by the stamping process. The pattern of the deformations may also appear as a series of corrugated ribs, or alternately, the entire skin 170 may appear to be corrugated. Such corrugations or deformations 172 provide overall stiffening and resistance to lateral force or shear force applied to the wall strengthening component 10.

The upper 176 and lower ends 178 (FIG. 12) of the wall strengthening component 10 are bent outwardly forming a flange 180 around the peripheral edges at top and bottom portions. The flange 180 is used to fasten the wall strengthening component 10 to the wall or frame, as is described above. A plate 180 may be attached to the flanges at the upper 176 and lower ends 178 to further aid fastening the component 10 in place. Additionally the hat channel 100 (FIG. 12) may be added as a separate element, or may be stamped into the skin as an elevated deformation.

Specific embodiments of a wall strengthening component according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A reinforced wall for a building construction, the reinforced wall comprising:

a top stud;

a bottom stud;

a plurality of spaced-apart vertical studs extending between and operably attached to the top and bottom studs;

a wall strengthening component comprising:

first and second vertical support members disposed in a spaced apart relationship;

a plurality of reinforcing members disposed between the first and second vertical support members, wherein the plurality of reinforcing members are configured in a truss-like arrangement between the first and second vertical support members, wherein the plurality of reinforcing members resist lateral stress directed against the first and second vertical support members such that the position of the first vertical support member is maintained relative to the position of the second vertical support member; and at least one vertical channel member disposed between the first and second vertical support members, the at least one vertical channel member having oppositely disposed linear flange portions and a raised linear channel portion disposed between the flange portions, the flange portions configured to be fixedly attached to the reinforcing members and the linear channel portion providing a surface to which a planar siding or sheathing and the like are fastened, wherein the wall strengthening component is operatively mounted between adjacent vertical studs so that opposite vertical ends of the first and second vertical support members are fastened to the top and bottom studs.

2. The wall strengthening component according to claim 1 wherein the truss-like arrangement forms generally triangular shaped portions disposed between the vertical support members.

3. The wall strengthening component according to claim 1 wherein the vertical support members have a generally rectangular cross-sectional shape.

4. The reinforced wall according to claim 1 wherein the first vertical support member, the second vertical support member, the horizontal braces, and the at least one diagonal brace are formed from metal in a process selected from the group of processes consisting of a metal form rolling process and a metal stamping process.

5. The reinforced according to claim 1 wherein the first vertical support member, the second vertical support member, the horizontal braces, and the at least one diagonal brace are integrally formed with each other in a metal stamping process, a casting process, a molding process.

6. The reinforced wall according to claim 1 wherein the first vertical support member, the second vertical support member, and the plurality of reinforcing members are integrally formed with each other in a metal stamping process, a casting process, a molding process, or an extrusion process.

7. Process The reinforced wall according to claim 1 wherein the horizontal braces and the at least one diagonal brace are affixed to the vertical support members by fasteners selected from the group of fasteners consisting of welds, rivets, nut and bolt fasteners, press-fit, metal screws, crimps, chemical adhesive, and brackets.

8. The reinforced wall according to claim 1 wherein two of the reinforcing members are disposed horizontally and one of the reinforcing members is disposed diagonally so as to form a Z-shaped structure.

9. The reinforced wall according to claim 1 wherein the first vertical support member, the second vertical support member, and the plurality of reinforcing members are formed from metal in a process selected from the group of processes consisting of a metal form rolling process, a metal stamping process, a casting process, and an extrusion process.

10. The reinforced wall according to claim 1 wherein the first vertical support member, the second vertical support member, and the plurality of reinforcing members are integrally formed with each other in a metal stamping process.

11. The reinforced wall according to claim 1 wherein the plurality of reinforcing members are affixed to the vertical support members by fasteners selected from the group of fasteners consisting of welds, rivets, nut and bolt fasteners, press-fit, metal screws, crimps, chemical adhesive, and brackets.

* * * * *